US010300586B2

(12) United States Patent
Wang

(10) Patent No.: US 10,300,586 B2
(45) Date of Patent: May 28, 2019

(54) SCREW HOLDING AND DISPENSING DEVICE

(71) Applicants: Fu Tai Hua Industry (Shenzhen) Co., Ltd., Shenzhen (CN); HON HAI PRECISION INDUSTRY CO., LTD., New Taipei (TW)

(72) Inventor: Wei-Ling Wang, Shenzhen (CN)

(73) Assignees: Fu Tai Hua Industry (Shenzhen) Co., Ltd., Shenzhen (CN); HON HAI PRECISION INDUSTRY CO., LTD., New Taipei (TW)

( * ) Notice: Subject to any disclaimer, the term of this patent is extended or adjusted under 35 U.S.C. 154(b) by 29 days.

(21) Appl. No.: 15/605,974

(22) Filed: May 26, 2017

(65) Prior Publication Data

US 2017/0341207 A1 Nov. 30, 2017

(30) Foreign Application Priority Data

May 28, 2016 (CN) ..... 2016 1 0370276

(51) Int. Cl.
*B25B 23/06* (2006.01)
*B65D 83/04* (2006.01)

(52) U.S. Cl.
CPC ..... *B25B 23/06* (2013.01); *B65D 83/0409* (2013.01)

(58) Field of Classification Search
CPC ..... B23K 3/082; B23K 3/0623; B25B 23/06; B25B 23/065; B65D 35/28; B65D 83/0409; B65D 83/0445
See application file for complete search history.

(56) References Cited

U.S. PATENT DOCUMENTS 4,139,036 A * 2/1979 Regan ..... B25B 23/045 227/136
4,854,761 A * 8/1989 Smith ..... A45D 29/007 132/73.5
4,887,738 A * 12/1989 Jennings ..... B65D 83/0409 221/221
4,889,260 A * 12/1989 Zeller ..... A47F 1/08 221/197
5,143,216 A * 9/1992 Aurtoi ..... B21J 15/32 206/303
6,098,836 A * 8/2000 Gottselig ..... A47K 10/32 206/204
6,551,265 B1 * 4/2003 Miguel ..... B43K 8/00 401/57
6,840,402 B2 * 1/2005 Lin ..... G01J 5/021 221/198
6,860,666 B2 * 3/2005 Chien ..... B43K 23/08 401/17

(Continued)

*Primary Examiner* — Gene O Crawford
*Assistant Examiner* — Kelvin L Randall, Jr.
(74) *Attorney, Agent, or Firm* — ScienBiziP, P.C.

(57) ABSTRACT

A screw holding and dispensing device includes a casing, a number of elastic members latched on an inner sidewall of the casing, and a pressing member received by the elastic member. Each elastic member carries a screw, to release a screw, an external force is applied on the pressing member, the pressing member is driven to move out of the top elastic member, the pressing member moves down and drives out the lowermost screw from the bottom elastic member, and the screw slides into a corresponding screw hole.

8 Claims, 4 Drawing Sheets

(56) References Cited

U.S. PATENT DOCUMENTS

| | | | | |
|---|---|---|---|---|
| 7,226,228 | B1 * | 6/2007 | San Miguel | A61B 17/00491 401/57 |
| 7,731,439 | B2 * | 6/2010 | San Miguel | A61B 17/00491 401/57 |
| 8,087,325 | B2 * | 1/2012 | Neubardt | A61B 90/98 206/347 |
| 8,474,679 | B2 * | 7/2013 | Felix | A61B 17/064 227/175.1 |
| 2004/0243139 | A1 * | 12/2004 | Lewis | A61B 17/862 606/104 |
| 2005/0171562 | A1 * | 8/2005 | Criscuolo | A61B 17/064 606/151 |
| 2010/0049215 | A1 * | 2/2010 | Kayan | A61B 17/0684 606/139 |
| 2016/0270778 | A1 * | 9/2016 | Zergiebel | A61B 17/064 |

* cited by examiner

SCREW HOLDING AND DISPENSING DEVICE

CROSS-REFERENCE TO RELATED APPLICATIONS

This application claims priority to Chinese Patent Application No. 201610370276.8 filed on May 28, 2016, the contents of which are incorporated by reference herein.

FIELD

The subject matter herein generally relates to materials handling, and particularly to a screw holding and dispensing device.

BACKGROUND

In industrial manufacture, screws are widely used as fastening components. Generally, the screws are attracted by a magnetic device, such as magnetic screwdriver. However, the screws are easily dropped from the magnetic screwdriver because they are so small.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
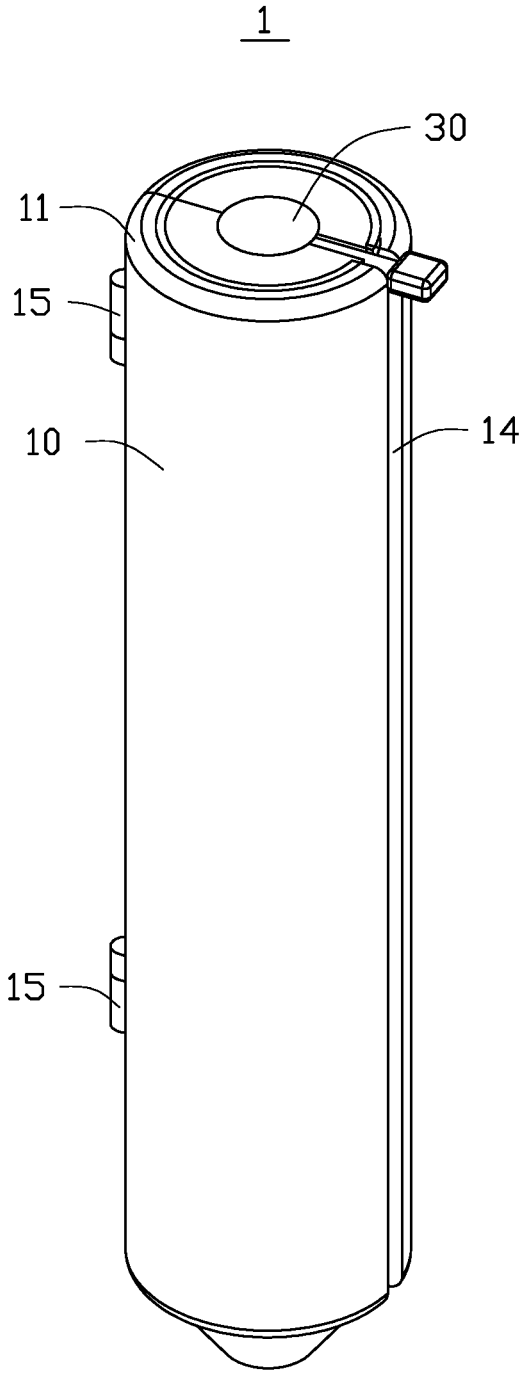
FIG. 1 is a schematic view illustrating an exemplary embodiment of a screw holding and dispensing device.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts have been exaggerated to better illustrate details and features of the present disclosure.

The present disclosure, including the accompanying drawings, is illustrated by way of examples and not by way of limitation. Several definitions that apply throughout this disclosure will now be presented. It should be noted that references to "an" or "one" exemplary embodiment in this disclosure are not necessarily to the same exemplary embodiment, and such references mean "at least one".

The term "comprising" means "including, but not necessarily limited to", it specifically indicates open-ended inclusion or membership in a so-described combination, group, series, and the like.

Figure 2:
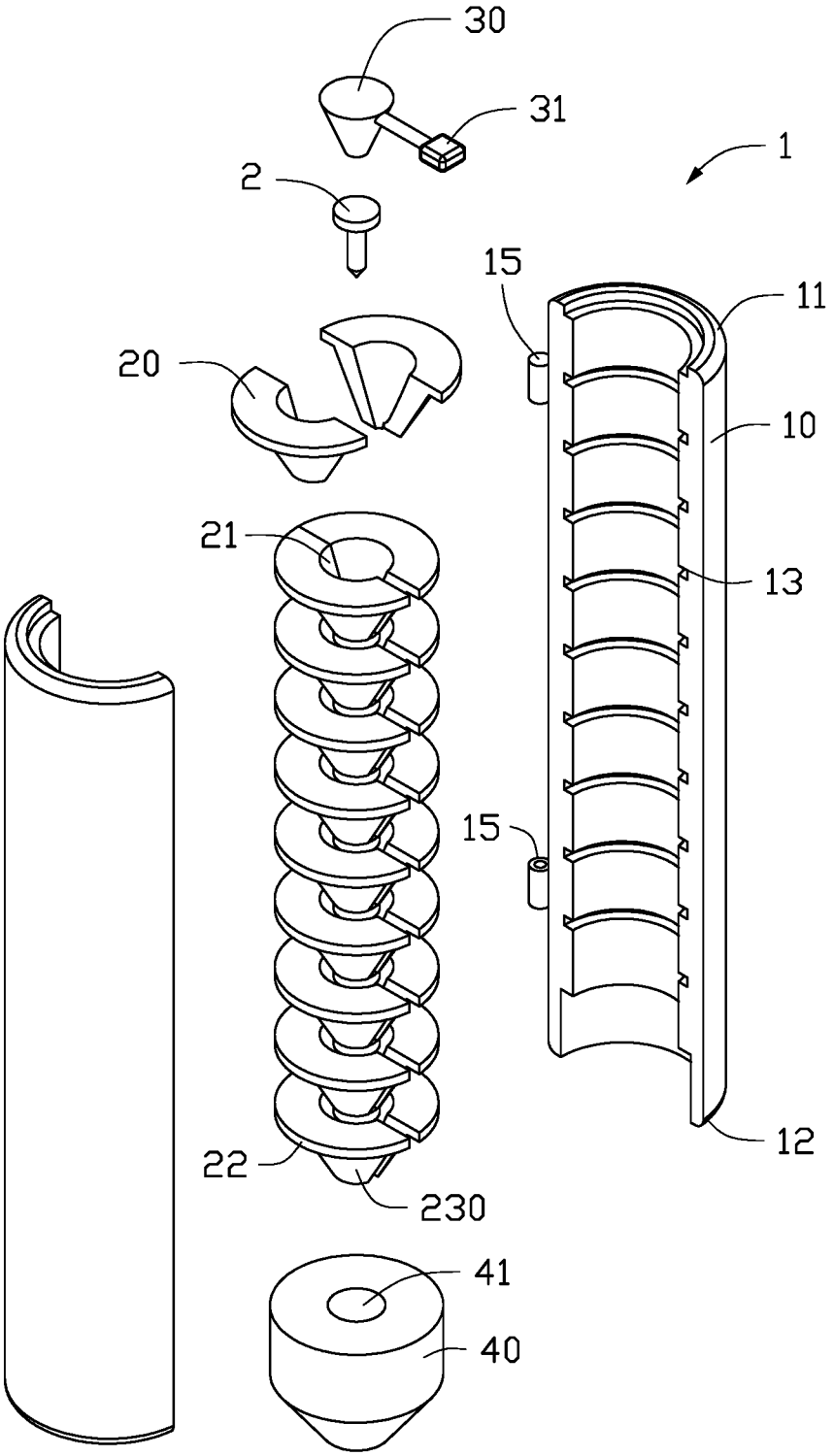
FIG. 2 is an exploded view of the device in FIG. 1.

FIGS. 1-2 illustrate an exemplary embodiment of a screw holding and dispensing device 1. The device 1 includes a casing 10, a number of elastic members 20, and a pressing member 30.

Figure 3:
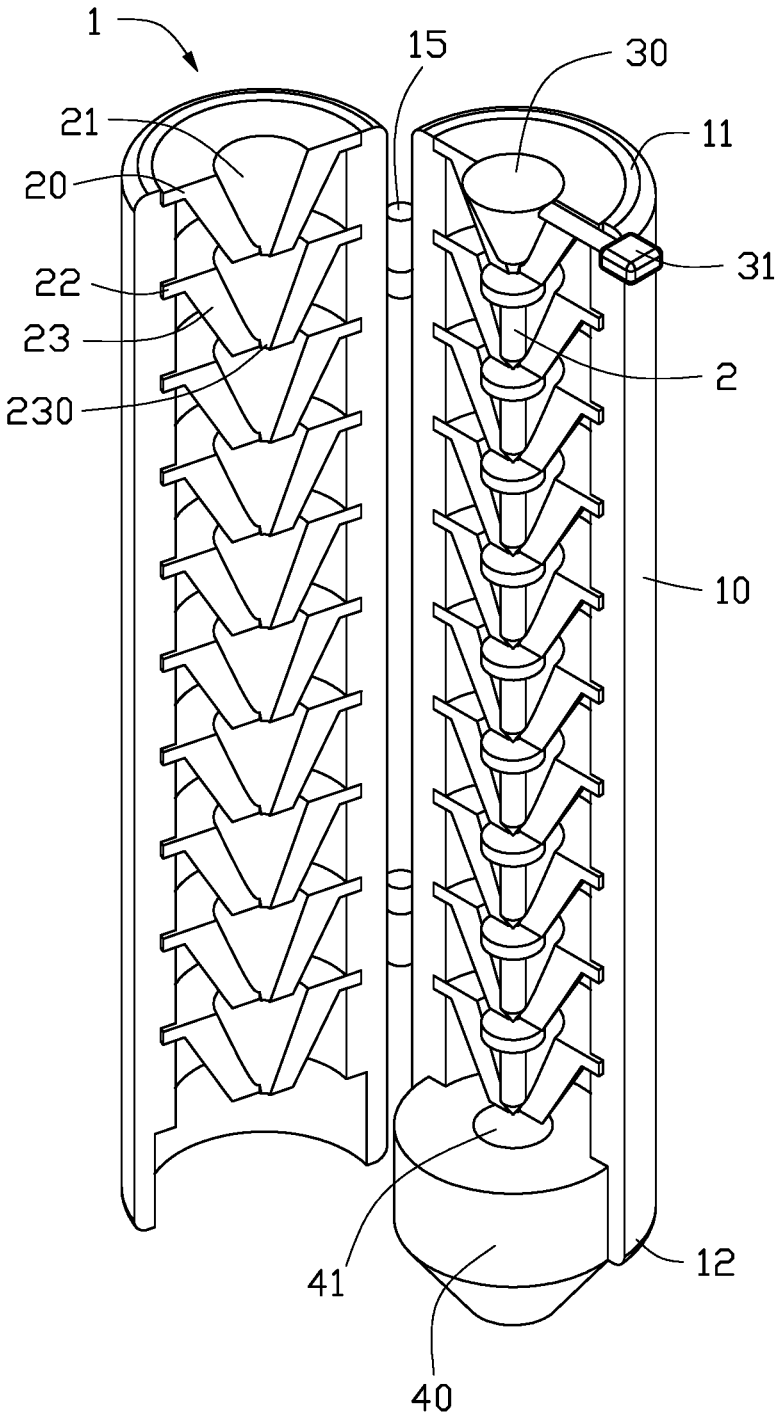
FIG. 3 is a schematic view illustrating the screw holding and dispensing device in an open state.

Referring to FIG. 3, the number of elastic members 20 are latched on an inner sidewall of the casing 10. The size of the elastic members 20 is the same. Each of the elastic members 20 defines a receiving space 21. In at least one exemplary embodiment, the pressing member 30 is received in the receiving space 21 of the top elastic member 20. A screw 2 is received in each receiving space 21 of the other elastic members 20.

When releasing the screw 2, a user can apply an external force on the pressing member 30. The pressing member 30 is driven to move out of the top elastic member 20 by the external force, the pressing member 30 moves down, and drives a below screw 2 to move out of the corresponding elastic member 20. At this time, all of the screws 2 are driven to move down. When the pressing member 30 is driven to move into the next elastic member 20, the bottom elastic member 20 releases the received screw 2, then the screw 2 can slide into a corresponding screw hole (not shown).

Figure 4:
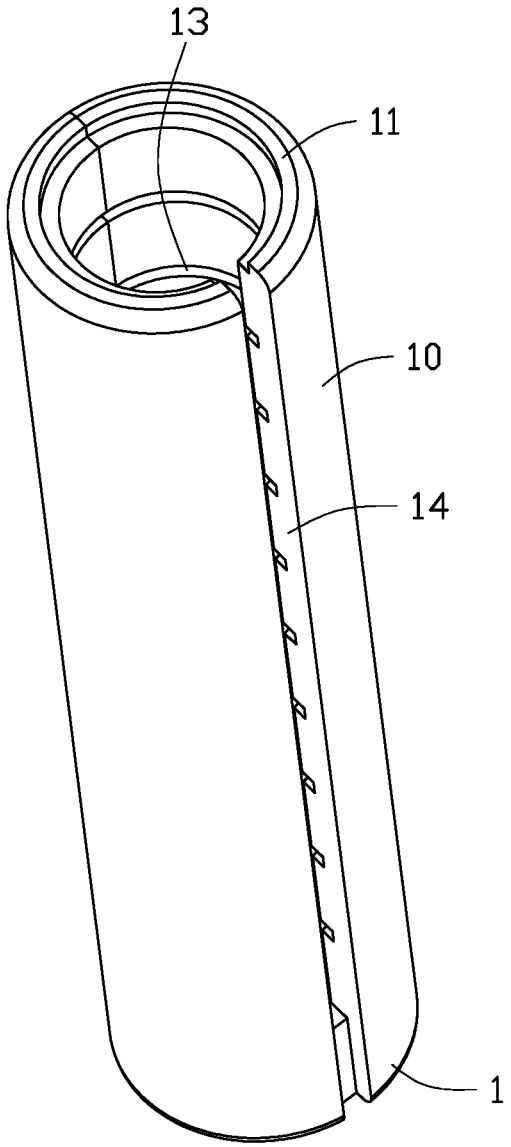
FIG. 4 is a schematic view illustrating a casing of the screw holding and dispensing device.

Referring to FIG. 4, the casing 10 is hollow and cylinder-shaped, a top end 11 and a bottom end 12 of the casing 10 are both open. The inner sidewall of the casing 10 defines a number of grooves 13. In at least one exemplary embodiment, a quantity of the grooves 13 is the same as a quantity of the elastic members 20, each of the elastic members 20 is latched in one of the grooves 13. The casing 10 further defines a slot 14, the slot 14 is continuous from the top end 11 to the bottom end 12 of the casing 10.

As illustrated in FIGS. 2-3, in at least one exemplary embodiment, the elastic member 20 is hollow and a shape of an inverted cone. An upper end 22 of the elastic member 20 is latched in the groove 13, and a bayonet 230 is formed on a lower end 23 of the elastic member 20. The bayonet 230 is elastic, and is used for supporting the pressing member 30 or the screw 2 received in the elastic member 20.

In at least one exemplary embodiment, when the pressing member 30 and the screw 2 are driven to move down, the bayonet 230 can be enlarged when extruded by the pressing member 30 and the screw 2, thus, the pressing member 30 and the screw 2 can move out of the corresponding elastic member 20. When the pressing member 30 and the screw 2 are driven to move into the next elastic member 20, the bayonet 230 restores to an initial state by an elastic restoring force, and supports the pressing member 30 or another screw 2.

In at least one exemplary embodiment, a shape of the pressing member 30 matches with the shape of the receiving space 21 of the elastic member 20, that is, the pressing member 30 is cone-shaped, and is received in the receiving space 21 of the top elastic member 20. The pressing member 30 defines an operation member 31, the operation member 31 is exposed out of the casing 10 from the slot 14. When releasing the screw 2, the user can control the operation member 31 to slide in the slot 14, thus, the pressing member 30 can be driven to move down.

As illustrated in FIG. 3, the device 1 further includes a guiding member 40. The guiding member 40 is fixed on the bottom end 12 of the casing 10. In at least one exemplary embodiment, an inner sidewall of the bottom end 12 defines a first thread (not shown), an outside surface of the guiding member 40 defines a second thread (not shown), the first thread matches with the second thread.

The guiding member 40 defines a through hole 41. The through hole 41 is used for guiding the screw 2 to slide down, the through hole 41 is aligned with the bayonet 230 of the bottom elastic member 20. A diameter of the through hole 41 is greater than a diameter of a nut of the screw 2. When the bottom elastic member 20 releases the screw 2, the screw 2 slides into the through hole 41, and is guided by the through hole 41 to drop into a corresponding screw hole.

In at least one exemplary embodiment, the casing 10 further defines two pin connection mechanisms 15. The casing 10 can be opened or closed along the two pin connection mechanisms 15. When there is no screw 2 in the device 1, the pressing member 30 is received in the bottom elastic member 20. At this time, the user can manually open the casing 10, reposition the pressing member 30 into the receiving space 21 of the top elastic member 20, and place the screws 2 into the receiving space 21 of the other elastic members 20.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. A screw holding and dispensing device comprising:

a casing;

a plurality of elastic members latched on an inner sidewall of the casing and each elastic member defining a receiving space; and a pressing member received in the receiving space of a top elastic member;

wherein at least one screw is received in each receiving space of each elastic members, the inner sidewall of the casing defines a plurality of grooves, a quantity of the grooves is the same as a quantity of the elastic members, each of the elastic members is latched in one of the grooves, when releasing the screw, an external force is applied on the pressing member, the pressing member is driven to move out of the top elastic member, the pressing member moves down and drives a below screw to move out of a corresponding elastic member, when the pressing member is driven to move into a next elastic member, a bottom elastic member releases the received screw, then the screw slides into a corresponding screw hole.

2. The screw holding and dispensing device according to claim 1, wherein sizes of the plurality of the elastic members are the same.

3. The screw holding and dispensing device according to claim 1, wherein the casing is hollow and cylinder-shaped, a top end and a bottom end of the casing are both open.

4. The screw holding and dispensing device according to claim 3, wherein the casing further defines a slot, the slot is continuous from the top end to the bottom end of the casing.

5. The screw holding and dispensing device according to claim 3, wherein the elastic member is hollow and a shape of an inverted cone, an upper end of the elastic member is latched in the groove, and a bayonet is formed on a lower end of the elastic member, the bayonet is elastic, and is used for supporting the pressing member or the screw received in the elastic member.

6. The screw holding and dispensing device according to claim 4, wherein the pressing member is cone-shaped, the pressing member defines an operation member, the operation member is exposed out of the casing from the slot, when releasing the screw, the operation member is driven to slide in the slot, and the pressing member is driven to move down.

7. The screw holding and dispensing device according to claim 5, further comprising:

a guiding member fixed on the bottom end of the casing and defining a through hole, wherein the through hole is used for guiding the screw to slide down, the through hole is aligned with the bayonet of the bottom elastic member, a diameter of the through hole is greater than a diameter of a nut of the screw.

8. The screw holding and dispensing device according to claim 1, wherein the casing further defines two pin connection mechanisms, the casing is opened or closed along the two pin connection mechanisms.

* * * * *